US007552824B2

(12) United States Patent
Le et al.

(10) Patent No.: US 7,552,824 B2
(45) Date of Patent: Jun. 30, 2009

(54) PACKAGE WITH ELECTRONIC CIRCUITRY

(75) Inventors: Thanhhung Le, Mechanicsville, VA (US); Rune Haraldsson, Chester, VA (US)

(73) Assignee: MeadWestvaco Corporation, Glen Allen, VA (US)

( * ) Notice: Subject to any disclaimer, the term of this patent is extended or adjusted under 35 U.S.C. 154(b) by 263 days.

(21) Appl. No.: 10/559,990

(22) PCT Filed: Jun. 10, 2004

(86) PCT No.: PCT/US2004/018512

§ 371 (c)(1),
(2), (4) Date: Dec. 9, 2005

(87) PCT Pub. No.: WO2004/110336

PCT Pub. Date: Dec. 23, 2004

(65) Prior Publication Data

US 2006/0144747 A1 Jul. 6, 2006

Related U.S. Application Data

(60) Provisional application No. 60/477,514, filed on Jun. 10, 2003, provisional application No. 60/537,299, filed on Jan. 20, 2004.

(51) Int. Cl.
*B65D 83/04* (2006.01)
*G04B 47/00* (2006.01)

(52) U.S. Cl. ..... 206/534; 206/531; 368/10; 368/107

(58) Field of Classification Search ..... 206/531–532, 206/534.1, 538–539, 467–469; 368/10, 11, 368/15, 107, 109; 340/572.1–572.9
See application file for complete search history.

(56) References Cited

U.S. PATENT DOCUMENTS

| | | | |
|---|---|---|---|
| 3,207,302 | A | 9/1965 | Hobbs |
| 3,305,084 | A | 2/1967 | Higgins et al. |
| 3,759,375 | A | 9/1973 | Nappi |
| 4,616,316 | A | 10/1986 | Hanpeter et al. |
| 4,617,557 | A | 10/1986 | Gordon |

(Continued)

FOREIGN PATENT DOCUMENTS

| | | | |
|---|---|---|---|
| EP | 1214924 | A2 | 6/2002 |

(Continued)

*Primary Examiner*—Bryon P Gehman

(57) ABSTRACT

A package with electronic circuitry for use in monitoring the removal of items from a receptacle, such as medication tablets from a blister cavity. The package is assembled with a plurality of cards, including a blister card (20), a backing card (30), and a trace card (40). The blister card includes at least one protruding receptacle (29) having an open side. The backing card includes at least one breachable closed cell (32), mated to a blister card such that the closed cell spans across the open side of the receptacle. The trace card also includes at least one breachable closed cell (32) and circuitry (42), mated to the backing card so that the closed cells are aligned. In another embodiment the backing card may be a layer of conductive foil (62) and the trace card may include a dielectric overlay (64).

13 Claims, 3 Drawing Sheets

U.S. PATENT DOCUMENTS

| | | | | |
|---|---|---|---|---|
| 5,072,430 | A | 12/1991 | Eckernas et al. | |
| 5,172,812 | A * | 12/1992 | Wharton et al. | 206/531 |
| 5,412,372 | A | 5/1995 | Parkhurst et al. | |
| 5,836,474 | A | 11/1998 | Wessberg | |
| 6,010,771 | A | 1/2000 | Isen et al. | |
| 6,047,829 | A * | 4/2000 | Johnstone et al. | 206/531 |
| 6,050,622 | A | 4/2000 | Gustafson | |
| 6,244,462 | B1 | 6/2001 | Ehrensvard et al. | |
| 6,411,567 | B1 * | 6/2002 | Niemiec et al. | 368/10 |
| 6,574,166 | B2 * | 6/2003 | Niemiec | 368/10 |
| 6,839,304 | B2 * | 1/2005 | Niemiec et al. | 368/10 |
| 7,113,101 | B2 * | 9/2006 | Petersen et al. | 368/10 |
| 7,188,728 | B2 * | 3/2007 | Williams-Hartman | 206/532 |

FOREIGN PATENT DOCUMENTS

| | | | |
|---|---|---|---|
| WO | WO 9604881 | A1 * | 2/1996 |
| WO | WO 03/055769 | A1 | 7/2003 |

* cited by examiner

PACKAGE WITH ELECTRONIC CIRCUITRY

CROSS-REFERENCE TO RELATED APPLICATIONS

This application claims priority to co-pending U.S. Provisional Application No. 60/477,514, filed Jun. 10, 2003, and U.S. Provisional Application No. 60/537,299, filed Jan. 20. 2004, the entirety of which are incorporated herein by reference.

FIELD OF THE INVENTION

The present invention relates generally to systems and methods used for monitoring the dispensing, accessing, delivering or using of packaged items. More specifically the present invention is directed to monitoring healthcare behavior, such as compliance with a medication regimen. Accordingly, the embodiments described are improved pharmaceutical packages and pharmaceutical package inserts that include electronic circuitry for use with an electronic monitoring device.

BACKGROUND OF THE INVENTION

It is known to provide systems and methods for tracking the usage and delivery of medications. Mechanical dispensing systems are known and, more recently, pharmaceutical packages with various electronic monitoring features have been developed.

With regard to pharmaceutical packages that incorporate electronic monitoring features, it is known to construct an apparatus for dispensing medications from a uniquely shaped single foldable sheet that includes an internal electronic circuit. Further, it is known to construct a multi-layer protective seal which likewise includes an internal electronic circuit. Although the known devices create unique packages and provide certain features, they do not provide solutions that can be cost-effectively integrated into standard manufacturing processes or used together with existing package configurations.

Accordingly, there remains in the art a need for a system and method for electronically monitoring the dispensing of packages items, particularly medications in pharmaceutical packages, that is easily adapted for use with standard manufacturing processes and/or existing package configurations.

SUMMARY OF THE INVENTION

The present invention overcomes the deficiencies of the known art and the problems that remain unsolved by providing insertable cards which can be used together to form a package with electronic circuitry, or are easily integrated into existing manufacturing processes and package configurations to provide electronic monitoring functionality.

One component of an illustrated embodiment is a fold-over card. This fold-over card includes an array of open cells. Another component of an illustrated embodiment is a blister card. This blister card includes an array of receptacles with open sides for receiving items. A third component of an illustrated embodiment is a backing card that includes an array of breachable closed cells. After the items are deposited into the receptacles, the backing card is attached to the fold-over card in a manner that captures the items and seals the open side of the receptacles. A subsequent component of this embodiment is a trace card comprising an array of breachable closed cells and circuitry that spans these closed cells. Here the circuitry is printed on the trace card using conductive inks and conventional printing methods.

In assembling the above-referenced cards, the closed cells of the trace card are aligned with the closed cells of the backing card (or the receptacles, in the absence of a closed cell backing card), to facilitate access to the items. To access the items the user eventually breaches the circuit associated with the selected items and related closed cell. Upon exerting sufficient force on the item from a pliable end of the receptacle the item is pushed through the first closed cell, whether the first closed cell is located on the fold-over card or backing card. The user continues to push the item until it breaches the circuit spanning the related closed cell of the trace card. Upon breaching the cell bridge and related closed cell, the related closed circuit is broken. The breaking of the circuit is received and stored by an electronic monitoring device as the event of accessing the item.

Additional embodiments are contemplated and taught herein. One embodiment comprises a combined fold-over and blister card, together with a backing card and a trace card. Another embodiment comprises a combined blister and backing card, together with a trace card. Yet another embodiment comprises a fold-over card, a blister card, a foil backing, and a trace card with a dielectric overlay. In practice these additional embodiments may be constructed and used as described above.

DETAILED DESCRIPTION OF THE INVENTION

Generally speaking the systems and methods described herein are directed to electronically monitoring the removal of an item from a defined location, such as an enclosed package. By applying what is taught herein to existing package configurations or package assembly methods, it is easy to monitor the dispensing, accessing, delivering or using of a packaged item.

As required, embodiments of the present invention are disclosed herein; however, it is to be understood that the disclosed embodiments are merely exemplary of the invention that may be embodied in various and alternative forms. The figures are not necessarily to scale and some features may be exaggerated or minimized to show details of particular components. Therefore, specific structural and functional details disclosed herein are not to be interpreted as limiting, but merely as a basis for the claims and as a representative basis for teaching one skilled in the art to variously employ the present invention. For purposes of teaching and not limitation, the illustrated embodiments are directed to pharmaceutical packages.

Figure 1:
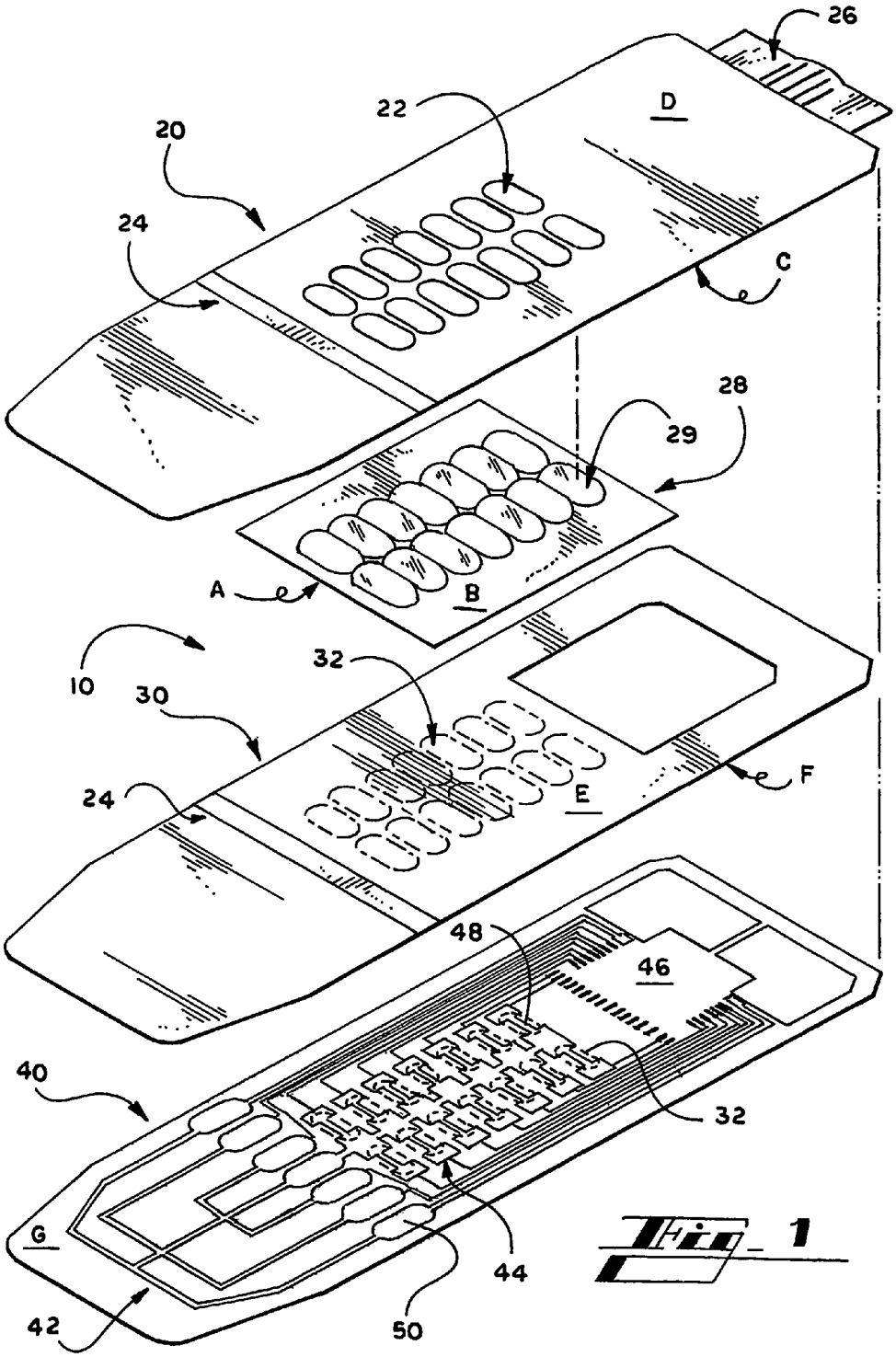
FIG. 1 is an exploded view of an embodiment of the present invention.

Referring now to the drawings wherein like elements are represented by like numerals, FIG. 1 illustrates an exploded view of an exemplary Improved Package with Electronic Circuitry ("PEC") 10, configured for use with the dispensing of medications in tablet form.

One component of this PEC 10 is a punched fold-over card 20. Typically a fold-over card is constructed of inexpensive disposable sheet-like material such as paper, paperboard, cardboard, plastic, or any combination thereof. This fold-over card 20 includes an array of open cells 22, formed by a prior pre-assembly step, such as a cutting, punching, scoring or forming depending on the material used. The illustrated fold-over card 20 further includes score lines 24 to facilitate final assembly as described below, and a locking tab 26 to be used as described below.

Another component of this PEC 10 is a blister card 28. This blister card 28 includes an array of blister cells 29. Typically a blister card 28 is thermo-formed from a plastic-type material to create blister cells 29, pliable protruding (concave when viewed from side A of the blister card) receptacles for receiving and storing medication in tablet form (not shown) to be accessed by a user. The actual configuration of the blister cards 28 and materials used are merely design choices.

Following an exemplary assembly process of a pharmaceutical manufacturer, side B of the blister card 28 is receivingly mated to side C of the fold-over card 20 so that each blister cell 29 is aligned with and nested within a respective open cell 22. In this configuration the blister cells 29 are ready to receive the medication tablets. Of course, side A of the blister card 28 may be mated with side D of the fold-over card 20 so that each blister cell 29 is aligned with a respective open cell 22 and ready to receive the medication tablets. The order of assembling these two cards 20, 28 does not determine when the medication tablets are deposited into the blister cavities 29. Accordingly the manufacturer does not need to alter its assembly process with regard to the components and steps described so far.

Another component of this PEC 10 is a backing card 30. This backing-card 30 includes an array of closed cells 32, which are best described as locations designed to facilitate breaching a card by pushing through a perforated or scored cell gate. Here the backing card 30 is constructed of non-conductive material. After the medication tablets are deposited into the blister cells 29, the backing card 30 is attached to the fold-over card 28 in a manner that captures the tablets and seals the blister cells 29. The backing card 30 may perform any or all additional functions, including receiving graphics, structural support, and insulting against the electronics described below. In the embodiment illustrated the backing card 30 is attached to side A of the blister card 28 and/or side C of the fold-over card 20. And for the reasons explained below, each closed cell 32 is aligned with a respective blister cavity 22.

It may be because of design criteria or the nature of the items being monitored that the fold-over card 20 and backing card 30 may be combined to perform the same functions. For example, in the illustrated embodiment the open cells 22 may be replaced with closed cells 32 and side A of the blister card 28 may be attached directly to side D of the fold-over card 20 after the tablets are deposited into the blister cells 29. Alternatively the blister card 28 may be configured to resemble the fold-over card 20 and attached directly to the backing card 30, after the tablets are deposited into the blister cells 29, such that each blister cell 29 is aligned with a respective closed cell 32.

A subsequent component of this PEC 10 is a trace card 40 comprising an array of closed cells 32 and circuitry 42. Here the trace card 40 is constructed of non-conductive material such as but not limited to paper, paperboard, cardboard, plastic, or any combination thereof. Here also, by way of illustration and not limitation, the configuration of the trace card 40 mimics the configuration of the fold-over card 20 and backing card 30. It is contemplated that the configuration of the trace card 40 is merely a design choice selected to best fit with new or existing packages or package manufacturing processes.

The illustrated circuitry 42 is applied directly on the trace card 40, in a manner well known by those skilled in the art. Here the circuitry 42 is printed on the trace card 40 using conventional printing or lithography methods such as but not limited to screen or off-set methods. The inks used in the printing method to form the circuitry 42 are conductive inks, selected based on the performance needs of the individual circuits 44. Conductive inks typically include conductive metals such as but not limited to copper or silver. Here the ink used to form the illustrated circuitry 42 is a carbon-based conductive ink readily understood by those skilled in the art.

Figure 3:
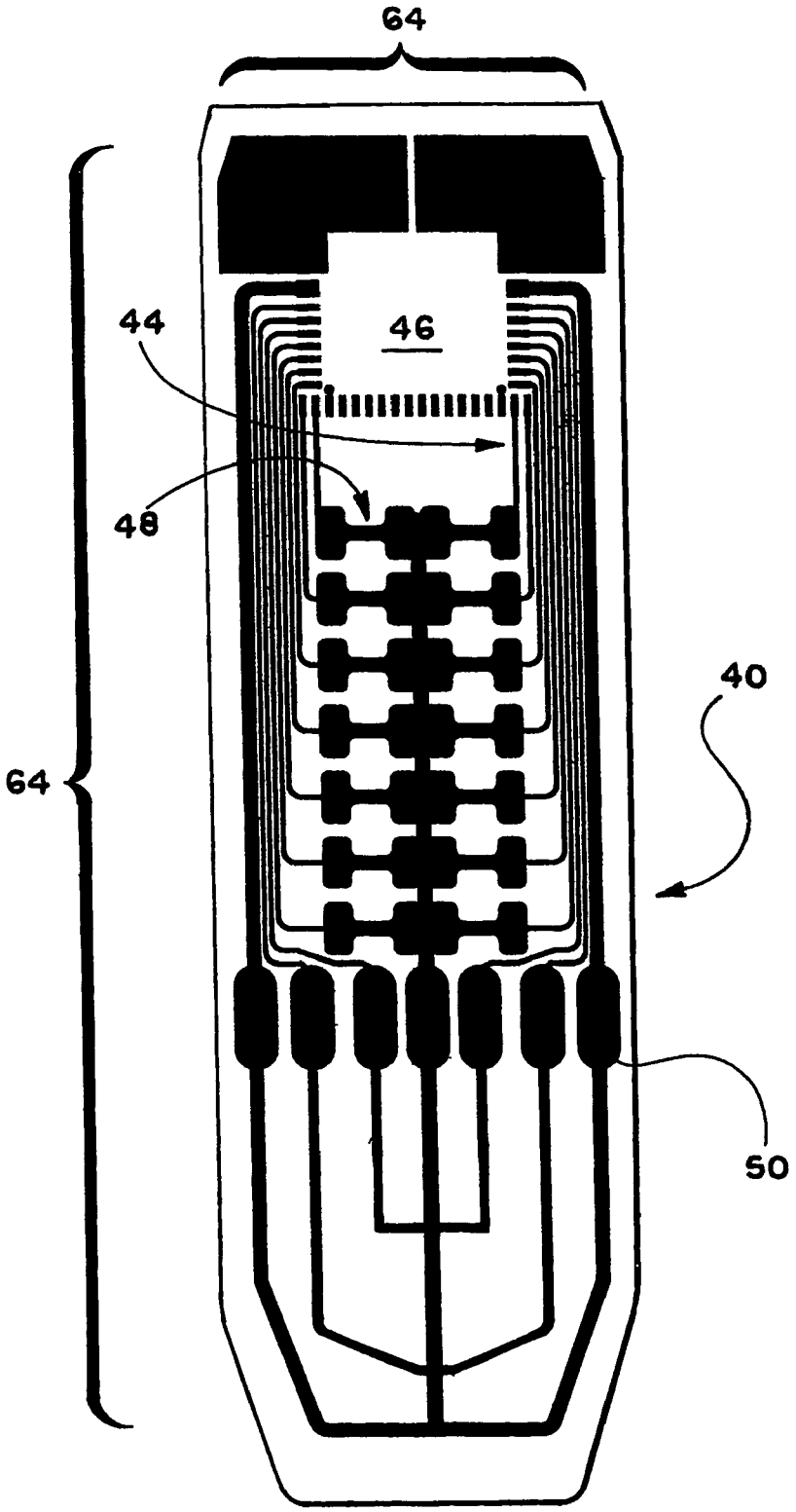
FIG. 3 is a plan view of the circuitry of FIG. 1 and FIG. 2.

As best illustrated in FIG. 3, the configuration of the circuitry 42 is likewise a design choice which, in a preferred embodiment, is based at least in part on the positions of the cells 29, 32. As is shown in FIG. 3 and will be understood by those skilled in the art, each individual closed circuit 44 typically extends from and returns to an electronic monitoring device (EMD, not shown) located at an electronic monitoring receiving area 46, and bridges a closed cell 32. In practice, when a closed cell 32 of the trace card 40 is opened as described below, the respective circuit 44 is broken. Here the breaking of a circuit 44 signals the removal of a tablet, an event that is captured and recorded by the EMD. Individual circuits 44 may be as wide or as narrow as required by the voltage and resistance requirements of the embodiment in use, but in the illustrated embodiments it is shown to widen the circuitry 42 over cells 32 and score lines 24 to reduce or eliminate false readings. Accordingly, the circuitry 42 comprises cell bridges 48 and score line bridges 50. It is contemplated that individual circuits 44 may be configured to accommodate switches, controls, and similar components that enhance monitoring functions.

In assembling the PEC 10 illustrated herein, the closed cells 32 of the trace card 40 are aligned with the closed cells 32 of the backing card 30 (or the blister cells 29, in the absence of a closed cell backing card), to facilitate access to the tablets. To access the tablet the user eventually breaches the cell bridge 48 associated with the selected tablet. Upon exerting sufficient force on the tablet from the outside surface of the blister cell 29 the tablet is pushed through the first closed cell 32, whether the first closed cell 32 is located on the fold-over card 20 or backing card 30. The user continues to push the tablet until it breaches the cell bridge 48 spanning the related closed cell 32 of the trace card 40.

Upon breaching the cell bridge 48 and related closed cell 32, the related closed circuit 44 is broken. The breaking of the circuit 44 is received and stored by the EMD as the event of accessing the tablet. Indicia regarding that event, including time of day, date, sequence or any number of event labeling indicia, as programmed in the EMD or devices in communication with EMD, may also be recorded and stored by the EMD. This event related indicia stored by the EMD may be read, retrieved, or transmitted as provided by the EMD in a manner understood by those skilled in the art.

The embodiment illustrated in FIG. 1 is described as being constructed of materials and by methods common to the industry example provided. The advantages of constructing embodiments with inexpensive materials and by manufacturing methods commonly used are readily apparent and do not require further explanation. Likewise, producing a system with a look and feel readily familiar to most consumers provides known advantages. Accordingly the use of insertable cards 20, 30, 40 to provide the flexibility to an existing industry application or existing package configuration is another advantage of the present invention.

For example, after assembly the PEC 10 may be combined with the outer sleeve taught in U.S. Pat. No. 6,047,829 (the '829 patent), assigned to the present applicant and incorporated herein by reference, by folding and inserting the PEC 10 into the outer sleeve as taught by the '829 patent. Alternatively trace card 40 of any by itself but complete with circuitry 42 and an EMD, may be attached to or combined with the inner slide card taught by the '829 patent. Thereafter, the unit dose packaging system taught therein, like any package configuration that includes an embodiment of the trace card 40, is enabled to electronically monitor the dispensing, accessing, delivering or using of the packaged items.

Figure 2:
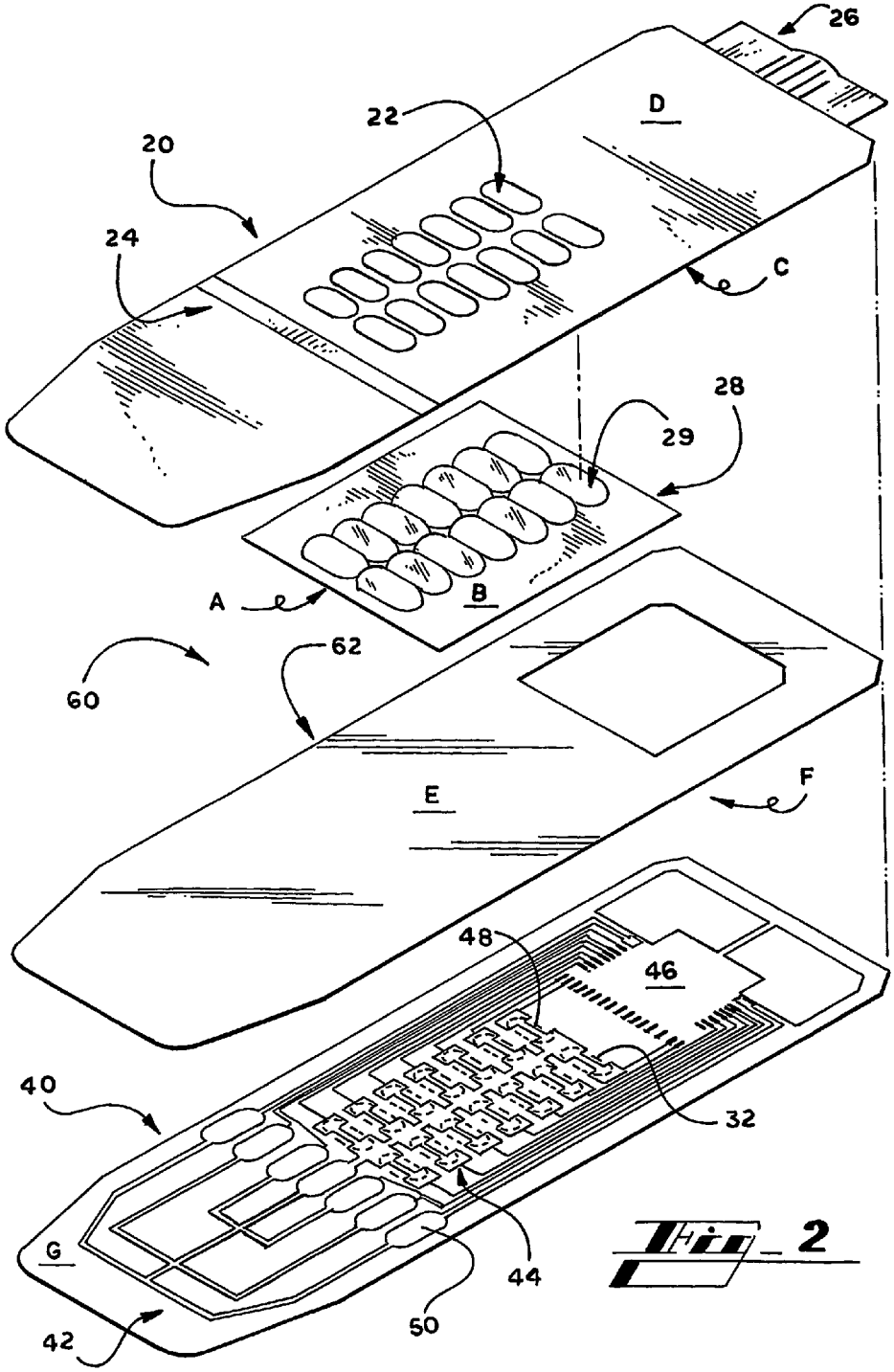
FIG. 2 is an exploded view of an embodiment of the present invention.

With regard to FIG. 2, in the healthcare industry it is known to use foil guard technology to seal and protect pharmaceuticals delivered in blister cards 28. Applying the teachings of the present invention to the embodiment PEC 60 there is shown a blister card 28 with tablets (not shown) configured to receive a protective film of foil 62 in a manner well known by those skilled in the art, that is, so that the foil 62 seals the blister cells 29 by being positioned immediately adjacent to side A of the blister card 28 and/or side C of the fold-over card 20.

Integrating the trace card 40 into the known foil guard technology requires only minor enhancement to the circuitry 42. It is known that foil 62 is conductive and the circuitry 42 is conductive. To eliminate electrical interference between the foil 62 and circuitry 42 with minimal impact on the present standard foil guard manufacturing process, a dielectric circuit overlay 64 is provided. In the illustrated embodiment the dielectric circuit overlay 64 is a non-conductive ink printed directly over the conductive printed circuitry 42 using the printing processes referenced herein. It will be understood that the overlay 64 may exactly follow and cover each circuit 44 and components 48, 50, or more broadly cover the circuit side of the trace card 40 where non-conductivity between the circuitry 42 and foil 62 is desired. It will be further understood that the overlay 64 may be any non-conductive thin covering, whether inks or plastics convenient to the manufacturer, that provides a sufficient dielectric barrier between the foil 62 and circuitry 42.

By adding the trace card 40 with its circuitry 42 and dielectric circuit overlay 64 to the standard foil guard technology manufacturing process, possibly as a last step or an outsourced step, the pharmaceutical manufacturer can add monitoring and compliance functions with minimum impact to its existing processes.

The embodiments taught herein are directed to single-use disposable packing, however such embodiments are not a limitation as reusable packing is contemplated. For example the blister cells 29 illustrated may be constructed of a durable latex and the backing card 30 illustrated may be constructed of a rigid metal or plastic with closed cells 32 that permit repeated access, such as are available with a hinged or replaceable friction-fit cell gate.

It will emphasized that the above-described embodiments of the present invention are merely possible examples of implementations set forth for a clear understanding of the principles of the invention. Many variations and modifications may be made to the above-described embodiments of the invention without departing substantially from the spirit and principles of the invention. All such modifications and variations are intended to be included herein within the scope of this disclosure and the present invention and protected by the following claims.

We claim:

1. A package with electronic circuitry, comprising:

a first card comprising at least one protruding receptacle, each protruding receptacle having a respective open side;

a conductive protective layer mated to said first card such that said protective layer spans across said open side; and a second card comprising at least one closed cell and electronic circuitry with a dielectric overlay, wherein said dielectric overlay is printed on said second card and spans at least a portion of said electronic circuitry, and further wherein the dielectric circuit overlay is patterned so as to follow and cover the electronic circuitry;

wherein said second card is positioned relative to said first card such that said dielectric overlay is adjacent to said protective layer and each said closed cell is breachably aligned with a respective said open side.

2. The package of claim 1, wherein said cards are non-conductive.

3. The package of claim 1, wherein at least a portion of said receptacle is pliable.

4. The package of claim 1, wherein said second card includes an electronic monitoring device receiving area in communication with said circuitry.

5. The package of claim 1, wherein a respective portion of said circuitry spans a corresponding said closed cell.

6. The package of claim 1 further comprising a third card, said third card comprising at least one open cell, wherein said at least one protruding receptacle is matingly nested within said at least one open cell.

7. The package of claim 6, wherein said third card further comprises a locking tab, said locking tab being configured to releasably retain said package within an outer sleeve.

8. The package of claim 1, wherein said dielectric overlay exactly follows and covers said electronic circuitry.

9. The package of claim 1, wherein said electronic circuitry is carried on a circuitry side of said second card, said dielectric overlay being carried on said circuitry side of said second card.

10. A package, comprising:

a blister card defining at least one blister cell, each blister cell having a blister opening, each blister opening being associated with a first side of the blister card;

a metal foil backing attached directly to the first side of the blister card, the metal foil backing sealing each blister opening; and a trace card mounted against the metal foil backing, the trace card carrying electrical circuitry and a dielectric circuit overlay, the dielectric circuit overlay covering the electrical circuitry, the dielectric circuit overlay being positioned between the metal foil backing and the electrical circuitry, the dielectric circuit overlay being patterned so as to follow and cover the electrical circuitry, at least one respective portion of the electrical circuitry being breachably aligned with a corresponding blister opening.

11. The package of claim 10, wherein the blister card and the metal foil backing together retain at least one dose of medication.

12. The package of claim 10, further comprising a third card having at least one open cell, the third card being mounted atop the blister card, each blister cell matingly received through a respective open cell of the third card.

13. The package of claim 12, wherein said third card further comprises a locking tab, the locking tab being configured to releasably retain the package within an outer sleeve.

* * * * *